United States Patent [19]

Tettweiler et al.

[11] 4,272,323

[45] Jun. 9, 1981

[54] PROCESS FOR PRODUCING COKE

[75] Inventors: Robert Tettweiler, Buchholz-Ohlenfeld; Hayri Ergun, Essen, both of Fed. Rep. of Germany

[73] Assignee: Didier Engineering GmbH, Essen, Fed. Rep. of Germany

[21] Appl. No.: 72,869

[22] Filed: Sep. 6, 1979

Related U.S. Application Data

[63] Continuation of Ser. No. 877,388, Feb. 13, 1978, abandoned.

[30] Foreign Application Priority Data

Feb. 12, 1977 [DE] Fed. Rep. of Germany ..... 2705971

[51] Int. Cl.[3] ..... C10B 17/00; C10B 53/08

[52] U.S. Cl. ..... 201/6; 201/10

[58] Field of Search ..... 201/6, 10, 44

[56] References Cited

U.S. PATENT DOCUMENTS

| | | | |
|---|---|---|---|
| 1,352,696 | 9/1920 | Roberts | 201/10 |
| 1,704,103 | 3/1929 | Rodgers | 201/10 X |
| 1,903,237 | 3/1933 | Johnston | 201/6 |
| 3,117,918 | 1/1964 | Batchelor et al. | 201/6 X |
| 3,907,648 | 9/1975 | Nire et al. | 201/6 |

FOREIGN PATENT DOCUMENTS

| | | | |
|---|---|---|---|
| 2613711 | 2/1978 | Fed. Rep. of Germany | 201/6 |
| 2705971 | 2/1978 | Fed. Rep. of Germany | 201/10 |
| 205677 | 10/1923 | United Kingdom | 201/6 |

OTHER PUBLICATIONS

Offenlegungschrift No. 2613711, Ergun I, Oct. 1977, Germany, 201-206.

Cooper, "By-Product Coking-2nd ed.", London, Benn Brothers Limited, 1923, p. 24, A.U.173.

*Primary Examiner*—Arnold Turk

*Attorney, Agent, or Firm*—Wenderoth, Lind & Ponack

[57] ABSTRACT

Briquettes, particularly molded briquettes of pitch-bound coal, are formed and introduced into a coking chamber of an indirectly heated chamber oven. The oven is then operated to form the briquettes into coke. Prior to the introduction of the briquettes into the chamber, the interior walls of the chamber are uniformly heated to a temperature $t_K \cong 1000 + [1000B - 175] \times [1.23 + 0.1283(W - 3)]$, wherein: B equals the width (in meters) of the coking chamber, and W equals the initial water content (in weight %) of the briquettes.

8 Claims, 1 Drawing Figure

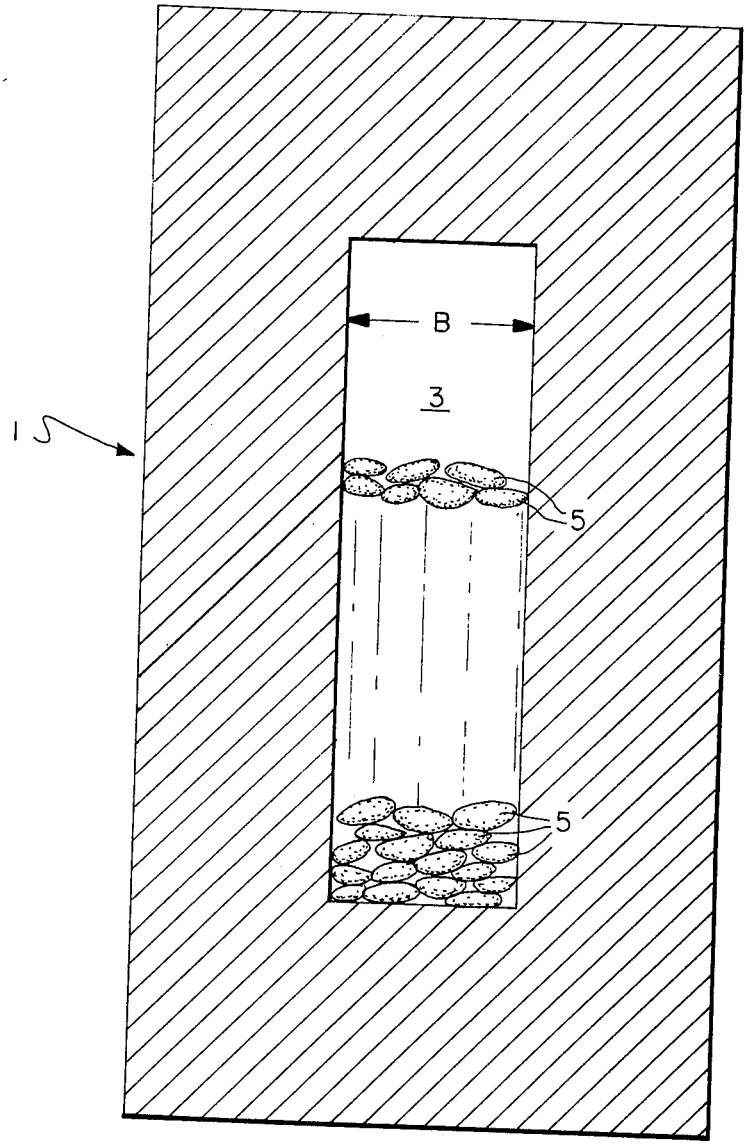
B
3
1
5
5

PROCESS FOR PRODUCING COKE

This is a continuation of application Ser. No. 877,388, filed Feb. 13, 1978, now abandoned.

BACKGROUND OF THE INVENTION

The present invention relates to an improved process for the production of coke, particularly for metallurgical purposes.

It is known to produce coke in an indirectly heated, discontinuously operated chamber oven. Specifically, it is known to form briquettes, particularly molded briquettes of pitch-bound coal, to introduce such briquettes into a coking chamber of an indirectly heated chamber oven, and to then coke the briquettes within the chamber of the oven to form coke. Such known process is described, e.g. see "Stahl und Eisen" 1972, pages 149 and 150; "Colliery Guardian Annual Review" 1974, page 54 and "Gluckauf-Forschungshefte" 1975, page 148. However, when producing coke by this known method, there invariably occurs the inherent disadvantage that the formed coke tends to cake during the coking operation, i.e. the pellets of coke formed from the initial briquettes tend to cake or stick together. This results in the operational problem of the caked coke being difficult to remove from the oven chamber after the coking operation, and further results in the quality control problem of unsatisfactory coke quality.

One attempt to overcome these problems of the known coke forming process is disclosed in German patent application No. P 26 13 711.1-24, wherein the molded briquettes are formed to have a particular surface area to volume ratio related in a particular manner to the interior width of the oven chamber, and wherein when employing chambers having relatively larger widths relatively large size molded briquettes are employed, and inversely when employing chambers having relatively small widths relatively smaller sized briquettes are employed.

Specifically, the process of such German patent application employs the use of molded briquettes formed according to the relationship:

$$k=0.5-O_B/V_B\times(1-e)\times B,$$

wherein: k equals the ratio between the total surface area of the briquettes contacting the interior walls of the chamber to the total surface area of the interior walls; $O_B$ equals the surface area (in $m^2$) of a briquette; $V_B$ equals the volume (in $m^3$) of a briquette; e equals the ratio between the total volume of the gaps or empty spaces between briquettes in a pile or charge of briquettes in the chamber to the total volume of the charge of briquettes; and B equals the width (in meters) of the chamber.

The invention of such German patent application is based upon the discovery that for every chamber of a given interior width there exists at a given heat flow a particular molded briquette size at which, during the coking operation, the briquettes and formed coke are neither caked nor deformed, such that the desired quality of coke is achieved while the oven chamber may be easily emptied after the coking operation. Accordingly, based on the discovery of the German application, there exists an optimum size of molded briquettes for a given chamber width, and inversely there exists an optimum chamber width for a given size of molded briquettes, whereat caking of the briquettes and formed coke during the coking operation is reduced.

It has however been found that even when employing the process of the above German application, there still occurs some caking.

SUMMARY OF THE INVENTION

With the above discussion in mind, it is the primary object of the present invention to provide an improvement in the known coke producing process wherein briquettes, particularly molded briquettes of pitch-bound coal, are formed, and wherein the briquettes are introduced into a coking chamber of an indirectly heated, discontinuously operated chamber oven, the oven then being operated to form the briquettes into coke.

It is a further object of the present invention to provide an improved process of the above type wherein it is possible to eliminate, or at least substantially eliminate caking of the briquettes and formed coke during the coking operation, such that coke of an improved quality is obtained, and whereby the oven chamber may be easily emptied after the completion of the coking operation.

It is a still further object of the present invention to provide such a process which is of particular advantage when employed with the process of the above mentioned German patent application.

These objects are achieved in accordance with the present invention by controlling the temperature of the interior walls of the oven chamber, prior to introduction into the chamber of the briquettes which are to be formed into coke. Specifically, prior to the introduction into the chamber of the briquettes, the temperature of all of the interior walls of the chamber is equalized to a temperature which bears a relation to the width of the interior of the chamber.

Specifically, in accordance with the present invention, prior to the introduction of the briquettes into the oven chamber, all of the interior walls of the oven chamber are uniformly heated to a temperature $t_K$ (in degrees Centigrade) approximately equal to:

$$t_K \cong 1000+[1000B-175]\times[1.23+0.1283(W-3)],$$

wherein B equals the width (in meters) of the coking chamber, and W equals the initial water content (in weight %) of the briquettes.

Preferably, the interior width of the coking chamber is dimensioned according to the relationship $0.20\ m \leqq B \leqq 0.45\ m$.

Further preferably, the briquettes are formed such that their initial water content (W) is according to the relationship $3\% \leqq W \leqq 9\%$.

Practical tests have shown that optimum coking is achieved without the disadvantage of caking when the above conditions are maintained. It has been found that the present invention is particularly effective in preventing the caking phenomena when the above conditions of the present invention are maintined in conjunction with the above described conditions of the process of the German patent application. It is possible that the improved performance and elimination of the caking phenomena is due to the fact that the heat flow to the briquettes within the oven chamber is stabilized such that a carbonization coke layer is formed around the briquettes in a relatively short time, such layer acting as a shell to protect the still soft core of the briquette against deformation, so that caking is avoided. However, it is not in any way intended to limit the scope of the present invention to this explanation.

BRIEF DESCRIPTION OF THE DRAWING

Other objects, features and advantages of the present invention will become apparent from the following detailed description thereof, taken with the accompanying drawing, wherein:

The single FIGURE is a schematic cross-sectional view across a typical coke oven and chamber, for the purpose of illustrating the features of the process of the present invention.

DETAILED DESCRIPTION OF THE INVENTION

In the single FIGURE of the drawing there is schematically illustrated a conventional indirectly heated, discontinuously operated coke oven 1 having therein a coking oven chamber 3. It is to be understood that the oven 1 and chamber 3 are represented schematically only, and the various flues and other conventional features of the oven are not illustrated. Oven chambers having one or a plurality of coking chambers are well known in the art, and the particular configuration of the oven and chamber, other than the width dimension of the chamber, does not in and of itself constitute the present invention. Accordingly, the specific structural features of the oven and the chamber are not further described or illustrated herein. It is however to be understood that the process of the present invention is employable in conjunction with any conventional and known oven and chamber.

In carrying out a coke forming process, briquettes 5 are formed and are then filled into oven chamber 3. The oven 1 is then operated in a known manner to form the briquettes 5 into coke. One conventional manner of forming briquettes 5 is to mold pitch-bound coal mixtures. It is to be understood however that the present invention applies to the use of briquettes of any conventional and known construction or formulation.

As discussed above, during conventional coking processes, during the coking operation, the briquettes 5 and the coke pellets formed therefrom tend to cake together. This makes is very difficult to remove the formed coke from the chamber 3 after the completion of the coking operation. Further, the quality of the coke is often nonuniform and of a low level.

However, it has been discovered in accordance with the present invention that this undesirable caking phenomenon can be avoided by controlling, in a particular manner, the temperature of the interior walls of the chamber 3 prior to the introduction of the briquettes 5 into the chamber 3. Specifically, it has been discovered that the caking phenomenon will be avoided if, prior to filling the chamber 3 with briquettes 5, all of the interior wall surfaces of the chamber 3 are uniformly and equally brought to a temperature $t_K$ (in degrees Centigrade) approximately equal to:

$$t_K \cong 1000 + [1000B - 175] \times [1.23 + 0.1283(W - 3)],$$

wherein: B equals the width (in meters) of the coking chamber, and W equals the initial water content (in weight %) of the briquettes.

It is to be understood that in the schematic FIGURE there are shown opposite side walls, a top wall and a bottom wall, but that the chamber 3 will also be defined by opposite lengthwise-spaced end walls.

It has particularly been found that the above temperature relationship is advantageous in eliminating the caking phenomenon when the width B of the coking chamber is dimensioned according to the relationship $0.20\ m \leqq B \leqq 0.45\ m$. It has even further been found that the above temperature relationship is particularly effective when the initial water content W of the briquettes is maintained according to the relationship $3\% \leqq W \leqq 9\%$.

The process of the present invention is particularly advantageous when it is employed in conjunction with the process of the above discussed German patent application No. P 26 13 711.1-24. More particularly, in accordance with this German patent application, the briquettes 5 are dimensioned such that the ratio of the surface area to the volume of the briquettes is maintained at a particular ratio with respect to the interior width of the oven chamber, and specifically according to the relationship:

$$k = 0.5 \times O_B/V_B \times (1 - e) \times B,$$

wherein: k equals the ratio between the total surface area of the briquettes contacting the interior walls of the chamber to the total surface area of the interior walls; $O_B$ equals the surface area (in $m^2$) of a briquette; $V_B$ equals the volume (in $m^3$) of a briquette; e equals the ratio between the total volume of the gaps or empty spaces between briquettes in a pile or charge of briquettes in the chamber to the total volume of the charge of briquettes; and B equals the width (in meters) of the chamber.

Further in accordance with the invention of the German application, it is understood that when a choice of different sized briquettes is available within the above limitations, relatively larger sized briquettes are employed with chambers having relatively larger interior widths, and relatively smaller sized briquettes are employed with chambers of relatively smaller internal widths.

In further accordance with the German application, the value of k is preferably approximately eight to eleven. The process of the German application can be further optimized when the porosity p (in percent) of the briquettes is according to the relationship $p \cong 3.32\sqrt[3]{V_B}$, particularly when the volume $V_B$ of a briquette is between approximately 100 and 360 $cm^3$. Additionally in accordance with the process of the German application, when the briquettes are relatively dry (i.e. with a water content of approximately 2%) it is desirable to employ a chamber having a relatively larger interior width B, than when employing briquettes having a relatively high water content (i.e. approximately 10%), assuming all other parameters are equal. It is desired that the quantity of distillation gas circulating in the empty space within the charge of the briquettes within the chamber during the coking operation be approximately 300 $Nm^3$ per ton of briquettes. When this quantity of distillation gas is not supplied by the particular briquette charge, then it would be necessary to introduce a rinsing gas into the chamber.

In one specific example of the coking process in accordance with the German application, the interior chamber width is 270 mm, and the ratio $O_B/V_B$ is approximately equal to 118 ($m^{-1}$). In this arrangement the major dimensions of each briquette are approximately 65 mm by 65 mm by 44 mm. In another example, at an interior chamber width of 450 mm, the optimum ratio $O_B/V_B$ is approximately equal to 71 ($m^{-1}$). In this example the major dimensions of each briquette are approximately 78 mm by 78 mm by 66 mm.

The weight of a briquette is preferably from 15 to 500 grams. It is not intended that the present invention be in any way limited to the particular shape or configuration of the briquettes employed, and the present invention is intended to be equally applicable to briquettes of spherical, cushion-shaped, egg-shaped, nut-shaped, or other conventional configurations.

Although it is not intended that the present invention be limited thereby, it is believed that one possible explanation for the elimination of the caking phenomenon in accordance with the present invention may be that the heat flow to each briquette within the chamber is stabilized such that a carbonization coke layer is formed around each briquette in a relatively short time, and that such layer operates as a shell to protect the still soft core of the briquette against deformation and to avoid caking and destruction of the briquette.

Althrough specific features of the present invention have been described in detail, it is to be understood that various modifications thereof may be made without departing from the scope of the present invention.

What is claimed is:

1. In a process for producing coke wherein briquettes, particularly molded briquettes of pitch-bound coal, are formed, said briquettes are introduced into a coking chamber of an indirectly heated chamber oven, and said oven is operated to form said briquettes into coke, the improvement wherein:

said briquettes are formed according to the relationship:

$$k=0.5\times O_B/V_B\times(1-e)\times B,$$

wherein:

k = the ratio between the total surface area of the briquettes contacting the interior walls of said chamber to the total surface area of said interior walls;

$O_B$ = the surface area (in $m^2$) of a briquette;

$V_B$ = the volume (in $m^3$) of a briquette;

e = the ratio between the total volume of the gaps or empty spaces between briquettes in a pile or charge or briquettes in the chamber to the total volume of the charge of briquettes; and B = the width (in meters) of the chamber; and prior to introducing said briquettes into said chamber, the interior walls of said chamber are uniformly heated to a temperature $t_K$ (°C.) approximately equal to:

$$t_K \approx 1000+[1000B-175]\times[1.23+0.1283(W-3)],$$

wherein:

B = the width (in meters) of the coking chamber; and

W = the initial water content (in weight % of the briquettes.

2. The improvement claimed in claim 1, wherein the width (B) of said coking chamber is dimensioned according to the relationship $0.20\ m \leqq B \leqq 0.45\ m$.

3. The improvement claimed in claim 2, wherein the initial water content (W) of said briquettes is according to the relationship $3\% \leqq W \leqq 9\%$.

4. The improvement claimed in claim 1, wherein the initial water content (W) of said briquettes is according to the relationship $3\% \leqq W \leqq 9\%$.

5. The improvement claimed in claim 1, wherein k is approximately from 8 to 11.

6. The improvement claimed in claim 1, wherein the porosity p (%) of said briquettes is according to the relationship $p \cong 3.32\sqrt[3]{V_B}$.

7. The improvement claimed in claim 1, further comprising, during the coking operation, circulating through said chamber approximately 300 $Nm^3$ gas per ton of briquettes within said chamber.

8. The improvement claimed in claim 1, wherein the width of said chamber comprises up to approximately 450 mm.

* * * * *